United States Patent [19]

Hoelzen et al.

[11] 4,372,212

[45] Feb. 8, 1983

[54] COMPOSITE SAFE AND ARMING MECHANISM FOR GUIDED MISSILE

[75] Inventors: Warren R. Hoelzen, Ontario; John F. Prescott; Michael N. Tyler, both of Lake Isabella, all of Calif.

[73] Assignee: The United States of America as represented by the Secretary of the Navy, Washington, D.C.

[21] Appl. No.: 209,574

[22] Filed: Nov. 24, 1980

[51] Int. Cl.[3] ..... F42C 5/00; F42C 15/06

[52] U.S. Cl. ..... 102/264; 89/1.812; 102/379

[58] Field of Search ..... 89/1.5 D, 1.812; 102/379, 300, 263, 264, 276, 228, 206, 202

[56] References Cited

U.S. PATENT DOCUMENTS

| | | | |
|---|---|---|---|
| 2,880,672 | 4/1959 | Menke et al. | 89/1.812 X |
| 3,298,310 | 1/1967 | Collins et al. | 102/276 |
| 3,728,936 | 4/1973 | Norris | 89/1.812 |
| 3,808,972 | 5/1974 | Cammack et al. | 102/265 X |
| 3,961,555 | 6/1976 | Zellmer et al. | 89/1.812 |
| 3,994,231 | 11/1976 | Rudeen et al. | 102/379 X |
| 4,013,012 | 3/1977 | Giattino | 102/218 |
| 4,158,334 | 6/1979 | Osburn | 102/229 |

*Primary Examiner*—David H. Brown

*Attorney, Agent, or Firm*—R. F. Beers; W. Thom Skeer

[57] ABSTRACT

An electro-mechanical mechanism is disclosed which controls safety-arming-firing of an air-launched missile's rocket motor and safety-arming of the warhead. The mechanism has an out-of-line safety pyrotechnic design to maintain the electric firing circuits and explosive train in an open, safe position until a complete sequence of events occurs. Similarly, a second sequence must occur before warhead arming can proceed.

8 Claims, 6 Drawing Figures

COMPOSITE SAFE AND ARMING MECHANISM FOR GUIDED MISSILE

BACKGROUND OF THE INVENTION

1. Field of the Invention

This invention relates to the fuze in an air-launched missile. More particularly, it relates to a fuze that combines the functions of (1) safing-arming-firing the missile rocket motor and (2) safing-arming the missile warhead.

2. Description of the Prior Art

Air launched missiles are equipped with a rocket motor and a warhead. Traditionally, safing and arming of the warhead and rocket motor have been accomplished through separate devices. The warhead safe and arm mechanism employs a series of redundant safety interlocks to allow safe and reliable carriage, release, and arming. These functions are duplicated for the rocket motor which adds to the number of parts in the missile. At the other extreme, engineers are trying to reduce the overall weight to allow better aircraft and missile performance.

In one prior art arming and safing device, a series of electrically-timed plungers and several return springs are employed, along with the rocket motor gases, to arm a warhead of an air-launched missile. That device uses several back-up parts to provide the necessary safety and reliability. The various parts interact with one another to provide fail-safe control.

SUMMARY OF THE INVENTION

The composite safe and arm mechanism of the instant invention is an electromechanical device which accomplishes two major functions: (1) safety-arming-firing for the missile's rocket motor and (2) safety-arming for the missile's warhead. The mechanism includes a mechanical and electrical out-of-line safety pyrotechnic mechanism. This system maintains electrical firing circuits and explosive trains in an open and safe condition until after the mechanism receives an intent-to-launch signal, a pull pin unlock signal, the missile physically separates from the aircraft, and a short time delay has occurred. Arming of the warhead explosive train occurs after the above sequence plus rocket motor pressure build-up, an arming time delay, an active transfer initiate, and a second short time delay.

OBJECTS OF THE INVENTION

It is therefore an object of the invention to integrate rocket motor ignition and warhead safing-arming into a single device.

It is a further object of the invention to utilize rocket motor gases to provide arming energy for warhead arming in lieu of a separate mechanism.

It is a still further object of the invention to construct a fuze that will insure physical separation of the missile from the aircraft before allowing warhead arming.

These and other objects of this invention will appear from the following specification, and are not to be construed as limiting the scope of the invention thereto, since in view of the disclosure herein, others may be able to make additional embodiments within the scope of the appended claims.

DESCRIPTION OF THE PREFERRED EMBODIMENT

Figure 1:
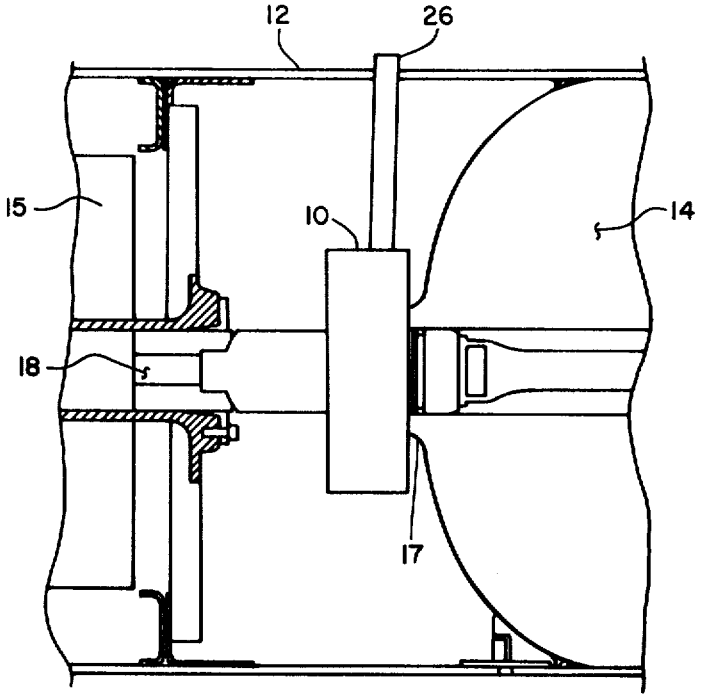
FIG. 1 shows a partial side view of an air-launched, guided missile with the composite safe and arm mechanism installed.

The composite safe-arm mechanism is designed to function in an air-launched, guided missile. FIG. 1 shows a partial side view of a safe-arm mechanism 10 installed in a missile 12. Missile 12 is of the type typically flown in combat and has a rocket motor 14 and a warhead 15. Mechanism 10 is threadedly fitted into the forward end of rocket motor 14 at interface 17 and connects to warhead 15 through an explosive train 18. As is typical with air-launched, guided missiles of this type, a missile autopilot, target sensors, a control processor and a thermal battery (all not shown in FIG. 1) sit in the forward section and are electrically connected to mechanism 10.

Figure 2:
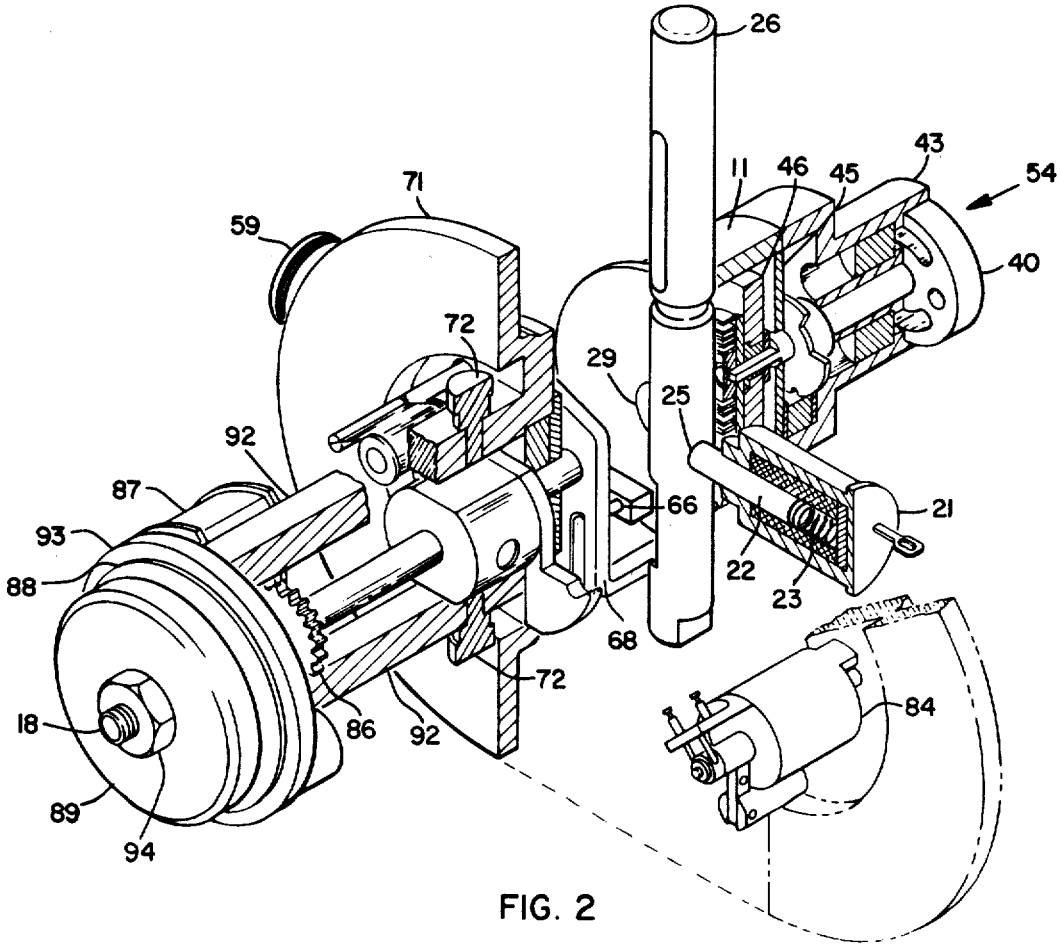
FIG. 2 shows a cut-away, perspective view of the composite safe and arm mechanism.
Figure 3:
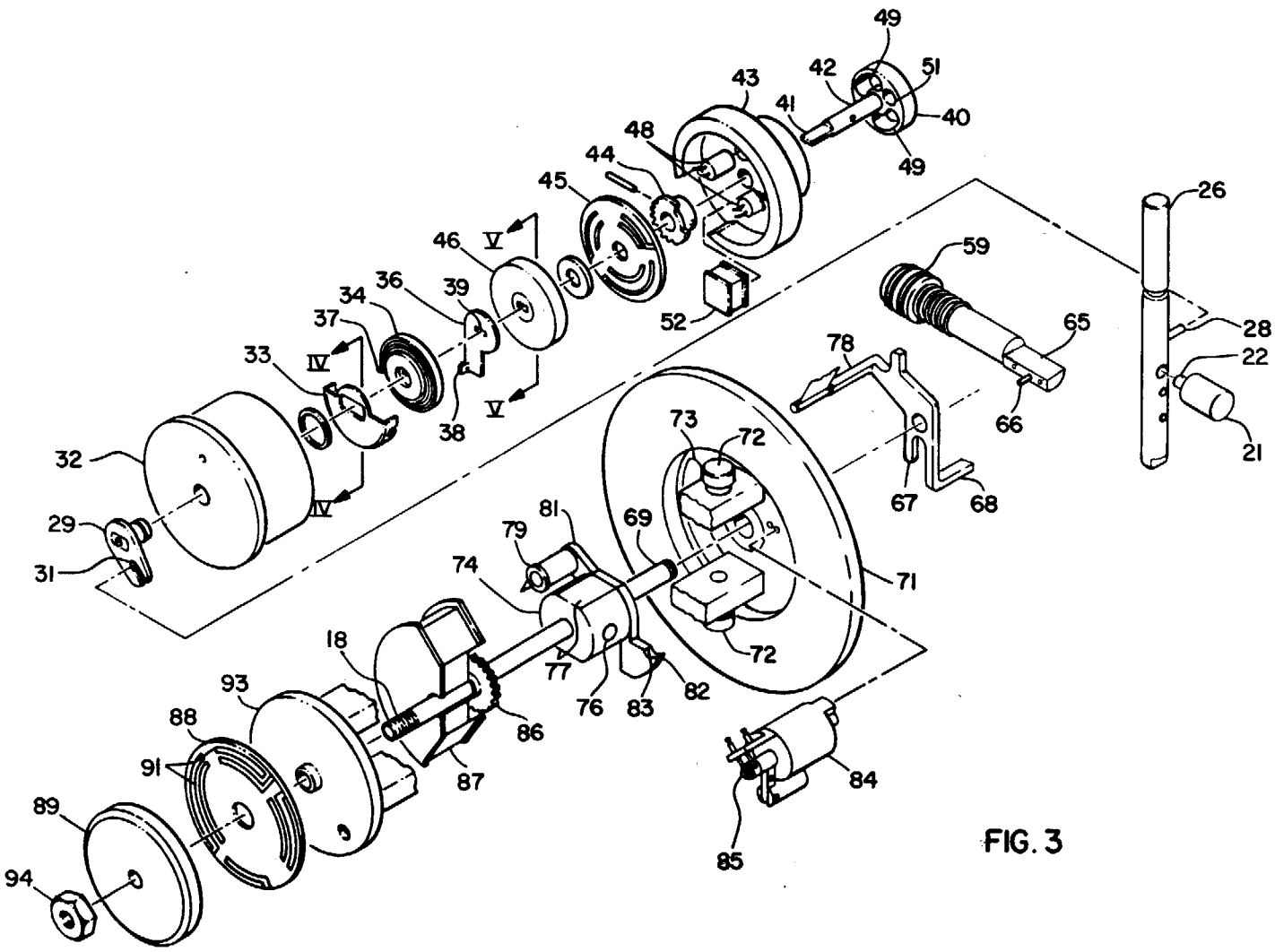
FIG. 3 shows an exploded view of the instant invention.
Figure 4:
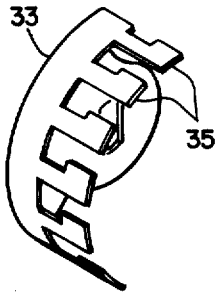
FIG. 4 is a sectional view taken along lines IV—IV of FIG. 3.

FIGS. 2–4 show in greater detail the individual elements of mechanism 10. FIG. 2 is a partial cutaway of a perspective view and FIG. 3 is an exploded view of the composite safe and arm mechanism.

When the decision is made to launch the missile, an electrical signal is sent to an intent-to-launch (ITL) solenoid 21. Solenoid 21 is a linear solenoid with a plunger 22 in opposition to an expansion spring 23. When power is applied through a safe-arm switch 89 to solenoid 21, plunger 22 is retracted against spring 23, and withdrawn from a lock hole 25 in a pull pin 26. When power is shut off to solenoid 21, spring 23 will force plunger 22 back to its first position.

Plunger 22 has a hardened tip (not shown) that interacts with pull pin 26. Pin 26 is sufficiently strong such that if the missile, with an approximate weight of 900 pounds, were to inadvertently fall away from the launch aircraft, the tip would not be sheared off and mechanism 10 would prevent rocket firing and arming of warhead 15.

Under normal operation, simultaneously with the signal to solenoid 21, the ejector rack on the launch aircraft pushes the missile away. This causes pull pin 26 to move upward and unblock a piston 59 and a safe-arm cocking lever 68.

As pull pin 26 moves upward, a small, arm-fire pin 28 (FIG. 3) located at the midway distance on pull pin 26, at a 90° angle to pull pin 26, forces arm-fire cocking arm 29 to rotate approximately 90° in a counter-clockwise direction. Arm-fire pin 28 rides in slot 31 on cocking arm 29.

Figure 5:
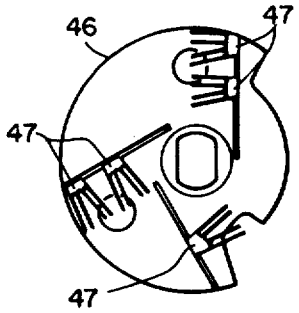
FIG. 5 is a sectional view taken along lines V—V of FIG. 3.

Cocking arm 29 is fixedly attached through a central hole in a cover 32 to a spring keeper 33. Spring keeper 33 is a hemispherically shaped plate with a series of tooth-like projections 35 extending from its outer edge at a right angle (see FIG. 4). A coiled spring 34 with a bent tip 37 rests adjacent to spring keeper 33. The bent tip 37 of spring 34 is securely attached around one of the projections 35 on spring keeper 33. A follower arm 36 is fixedly attached by a rectangular shaped hole 39 to a cooperatively shaped tip end 41 of a barrier shaft 42 and presses against coiled spring 34. The inner end of spring 34 is also attached to tip end 41. A tab 38 on follower arm 36 out at a 90 degree angle from arm 36 to an interferring position with lead projection 35. Barrier shaft 42 extends from the center of an ignition-blocking, disc-shaped barrier 40 through a circular squib block 43, a timing gear 44, a disc-shaped switch deck 45 and a circular, switch contact carrier 46 to coiled spring 34. FIG. 5 is a sectional view taken along lines V—V and shows how a plurality of switch brushes 47, small U-shaped conducting wires, are mounted on contact carrier 46. As carrier 46 is rotated, brushes 47 sweep around the electrical circuitry on switch deck 45 and open or close those circuits.

Squib block 43 is securely attached to casing 11 and carries two pyrotechnic ignition squibs 48 that are electrically connected through switch deck 45 and contact carrier 46 to the thermal battery. Squibs 48 extend through block 43, and in the "safe" position, are adjacent shallow depressions 49 in squib block 43. When barrier shaft 42 has rotated sufficiently, a pair of oppositely-disposed holes 51 (one shown) through barrier 40 align with squibs 48.

An escapement 52 is securely fastened to the inside of block 43 so as to interact with timing gear 44 to control the time necessary for barrier 40 to move to align holes 51 with squibs 48. In actual use, a delay time of 150 milsec is set in escapement 52. The force stored in spring 34 acts against follower arm 36 to rotate barrier 40. Timing gear 44 and escapement 52 control the rotation and allow a proper delay interval for the missile to separate from the aircraft before ignition. If squibs are ignited prior to full barrier rotation, the ignition of the rocket motor will be blocked by shallow depressions 49.

Figure 6:
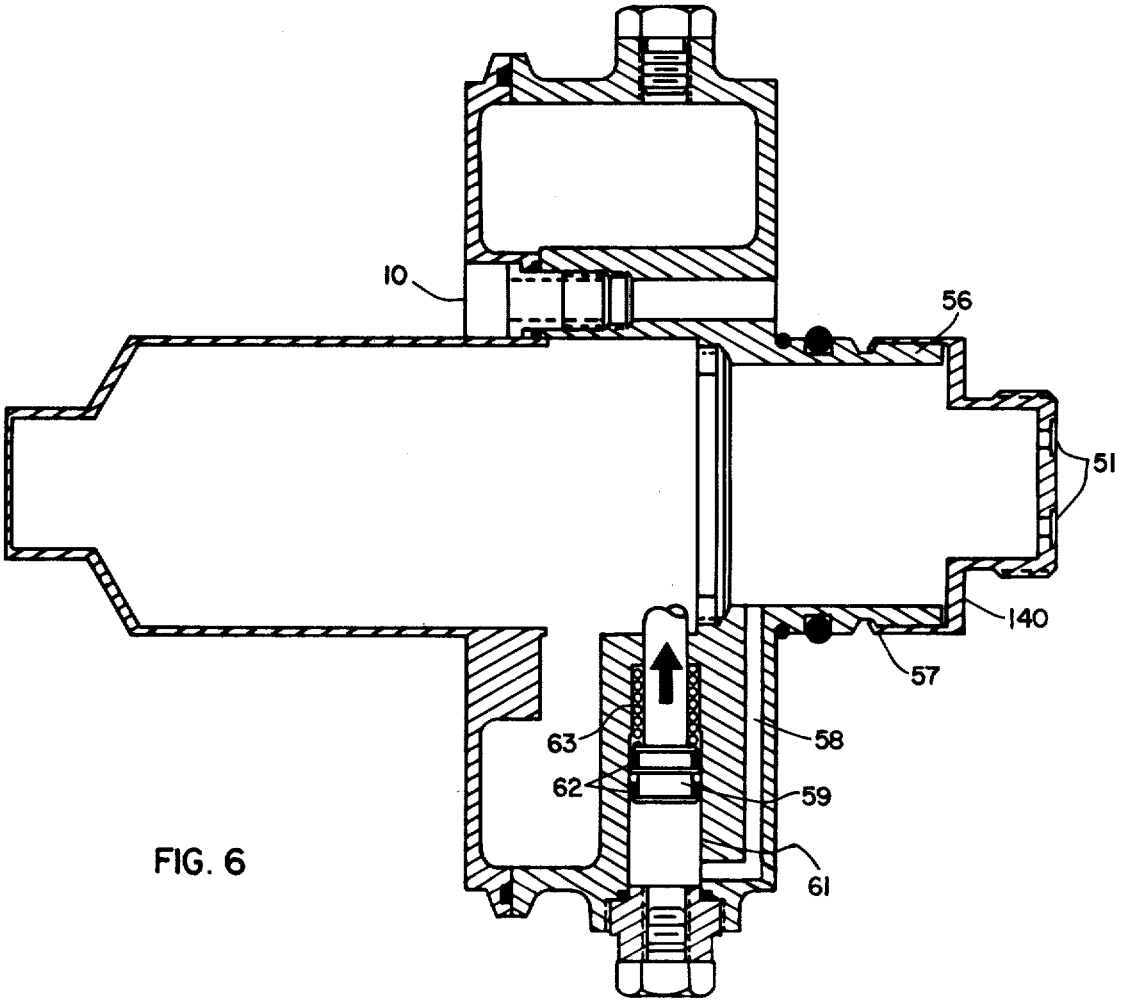
FIG. 6 shows a bottom view of the instant invention and the pressure lines for venting rocket motor pressure to the pressure piston.

After the rocket motor 14 is ignited, some of high pressure is vented back inside mechanism 10. FIG. 6 shows a plan view of the underside of mechanism 10 with some simplifications made for purposes of explanation.

Rocket motor pressure flows through holes 51 in housing 140. Housing 140 is hermetically sealed to casing 56 at a seal 57. The high pressure causes gas to flow through passage 58 to arrive at the head of pressure piston 59 and force piston 59 to move in the direction of the arrow. The head of piston 59 is hermetically sealed to the inside of piston shaft 61 by o-rings 62. A second, expansion spring 63 is positioned around piston 59 and acts against any movement of piston 59. When pressure on piston 59 drops below a predetermined level, spring 63 forces piston 59 back into shaft 61.

The opposite end from the head of piston 59 is formed in a flat bar shape 65 (FIG. 3) with a stroke pin 66 extending from the forward side thereof. Pin 66 slidingly moves inside of slot 67 on safe arm cocking lever 68. Lever 68 is pivotally attached to framework 71.

Explosive train 18, as previously described, is connected to a conventional booster (not shown) in the missile's warhead. Explosive train 18 is shaped into a slender shaft and extends through a hole in the center of a detonator framework 71. Framework 71 is a circular disk with a 90° arc 73 cut through the inner side portion from the seven o'clock position to the eleven o'clock position. Two MK 71 detonators 72 are securely attached to the inner portion of framework 71 at the six o'clock and twelve o'clock positions, as shown in FIG. 2. Fixedly attached to explosive train 18 and located coplanarly with detonators 72 is an explosive train interrupter 74. Interrupter 74 is a solid piece of cylindrical material with a pair of oppositely disposed openings 76 leading to explosive train 18. Interrupter 74 has two oppositely disposed flattened sides 77 that align with detonators 72 until after the rocket motor is ignited.

Safe-arm cocking lever 68 is built in the shape of a two-handled lever with the side opposite slot 67 slanted approximately 30° from the vertical. A solid bar 78 extends forward at a 90° angle from this side and has one end of a negator spring 79 anchored to it. Bar 78 extends through arcuate cut-out 73 to a position adjacent negator spring 79. Negator spring 79 is attached to one end of a two-ended lever 81. Lever 81 is attached to explosive train 18 at its center so that it also is offset 30° from the vertical. The end of lever 81, opposite negator spring 79, is in the form of a square with a hook-like portion 82 extending from the outer edge to be adjacent a notch 83. Also attached to the inner portion of framework 71, at about the 3 o'clock position, is an active-transfer-initiate (ATI) solenoid 84. Solenoid 84 is similar to solenoid 21 and has a plunger 85 that extends out into the path of rotation of hook 82.

Extending out from framework 71 are two stabilization bars 92 (FIG. 2). Bars 92 connect framework 71 with a buffer plate 93 at the 12 o'clock and six o'clock and serve as a housing for detonators 72. A second escapement 87 is attached between bars 92 and interacts with a second timing gear 86, which is fixedly attached to explosive train 18, to moderate the rate of rotation of explosive train 18, in the same manner as escapement 52 and first timing gear 44. Similarly, a second switch deck 88 with electric circuitry 91 is fastened to buffer plate 93, and circular safe-arm switch 89 is secured to the end of explosive train 18 by hex-nut 94. As safe-arm switch 89 rotates with explosive train 18, electrical leads travel around circuitry 91 on switch deck 88 and turn on or off power to ITL solenoid 21 and ATI solenoid 84.

The operation of safe-arm mechanism 10 will now be described. The first occurrence in the sequence sending power to ITL solenoid 21. This causes plunger 22 to withdraw from pull pin 26. Next, when missile 21 is ejected, pull pin 26 is raised enough to unblock both pressure piston 59 and safe-arm cocking lever. Arm-fire pin 28 causes arm-fire cocking arm to rotate 90°. When arm-fire cocking arm is moved, spring 34 starts to unwind, and a rotational force is exerted on barrier 40. Escapement 52 controls, through its movable connection to timing gear 44, the time necessary for electrical switch contact carrier 46 and barrier 40 to turn until all electrical connections to squibs 48 are complete and holes 51 are in line with squibs 48.

When the missile autopilot senses the above events, it sends an ignition signal to the thermal battery and power is transmitted to squibs 48. The resulting ignition starts the rocket motor and missile 12 assumes a powered-flight mode.

Rocket motor gas pressure, as indicated by arrow 54, flows back through barrier 40, and through vent 58 to pressure piston 59. This pressure forces piston 59 forward against the retarding force of spring 63. O-rings 62 prevent the passage of rocket motor gases into the warhead portion of missile 12.

When piston 59 is moved forward, pin 66 forces safe-arm cocking lever 68 to rotate up 90°, which in turn, extends negator spring 79. The subsequent rotation of interrupter 74 is controlled by escapement 87 and timing gear 86, and after a predetermined delay, timing gear 86 runs off escapement 87 and interrupter 74 snaps toward the armed position until notch 83 engages plunger 85. At this position, explosive leads 76 are 45° out of line with detonators 72 and the electrical circuits between safe-arm switch 89 and circuitry 91 are still open, and hence detonators 72 are immune to spurious firing signals.

The circuit to ITL solenoid 21, which is routed through switch 89, opens during the snap portion of travel. ITL plunger 22 is forced back and blocks safe-arm cocking lever 68 in the up position. Since lever 68 is locked in the rotated position, the arming energy is locked into negator spring 79 and no longer dependent on the presence of rocket motor pressure.

When target encounter is imminent, a signal is sent from missile sensors to ATI solenoid 84. Plunger 85 is withdrawn, and interrupter 74 snaps into the armed position. Rotation of switch 89 opens the circuit to ATI solenoid 84, and plunger 85 returns to the extended position, locking interrupter 74 in the armed position. Upon receipt of a firing signal, detonators 72 are initiated, and in turn, explosive train 18 is set off.

It will be understood that various changes in the details, materials, steps and arrangements of parts may be made by those skilled in the art within the principle and scope of the invention as expressed in the appended claims.

What is claimed is:

1. A composite safing and arming mechanism for a missile launched from an aircraft having a warhead; and a rocket motor, said mechanism comprising:

a mechanism casing connected between said rocket motor and said warhead;

a port in said mechanism casing communicating with said rocket motor for allowing pressure therefrom to enter said casing;

means for receiving an initial signal from said aircraft attached to said mechanism casing;

means for initiating the rocket motor after a predetermined time attached to said casing adjacent the rocket motor; and means for arming the warhead attached to said mechanism casing after receiving a predetermined amount of pressure through said port from said rocket motor.

2. A mechanism as in claim 1 wherein said receiving means comprises:

a pull pin connected to the aircraft and removably joined to said mechanism; and a first solenoid electrically connected through a rotatable switch to maintain said pull pin in said mechanism until receipt of said initial signal.

3. A mechanism as in claim 1 wherein said initiating means includes a rotatable safety barrier that prevents passage of gases until a predetermined rotation of said barrier occurs.

4. A mechanism as in claim 1 wherein said means for arming includes a pressure piston hermetically sealed between said mechanism casing and the rocket motor so as to stroke forward after a predetermined amount of gas pressure has built up in the motor.

5. A mechanism as in claim 4 wherein said means for arming comprises:

a plate with a bore extending through the center thereof centrally located in said casing and fixedly attached thereto;

an explosive train in the form of a rod extending through and rotating in said bore and leading to the warhead;

a safe-arm cocking lever adjacent said plate and pivotally attached to said train and rotationally attached to said pressure piston;

an interrupter for shielding said explosive train fixedly attached to said explosive train and having at least two openings extending therethrough to said train;

at least two detonators fixedly attached to said plate and connected to fire an electric impulse through said openings;

second spring means attached between said interrupter and said safe-arm cocking lever for transmitting rotational force from said safe-arm cocking lever to said interrupter;

second gear means for delaying rotation of said interrupter until after a predetermined time attached to said explosive train and said casing;

second electrical switching means attached to said explosive train for providing electrical power flow to said first solenoid and said detonators at predetermined times; and a second solenoid electrically connected to said second switching means and fixedly attached to said plate so as to provide a removable block to said interrupter.

6. A mechanism as in claim 1 wherein said means for initiating comprises:

a squib block having an interior and an exterior and having at least two pyrotechnic firing squibs and a centrally located aperture extending therethrough, said squib block being attached to said casing adjacent the rocket motor;

a perforated, rotatable barrier between the rocket motor and said squib block with a centrally located shaft extending therefrom and through said centrally located aperture;

first gear means for delaying rotation of said barrier shaft until after a predetermined time attached to said shaft and said squib block;

first electrical switching means for providing power to said squibs at a predetermined time adjacent said squibs;

an arm-fire cocking arm rotationally connected to said pull pin;

a spring keeper fixedly attached to said arm-fire cocking arm; and first spring means adjacent said spring keeper having an inner end attached to said barrier shaft and an outer end affixed to said spring keeper.

7. A mechanism as in claim 6 wherein said first gear means comprises an escapement fixedly attached to said squib block and in meshing relation with a circular gear affixed to said barrier shaft.

8. A mechanism as in claim 7 wherein said first electrical switching means comprises:

a switch deck having a plurality of electrical circuits thereon and attached to said casing; and a rotating switch contact carrier adjacent said switch deck with a plurality of switch brushes thereon so as to open and close said electrical circuits.

* * * * *